US006165082A

United States Patent [19]

Cox

[11] Patent Number: 6,165,082

[45] Date of Patent: Dec. 26, 2000

[54] SEMI-AUTOMATIC GOLF TEEING DEVICE

[76] Inventor: George W. Cox, 726 Lexington Ave., Terrace Park, Ohio 45174

[21] Appl. No.: 09/233,226

[22] Filed: Jan. 19, 1999

[51] Int. Cl.[7] ..... A63B 57/00

[52] U.S. Cl. ..... 473/390; 473/396; 473/132

[58] Field of Search ..... 473/132–137, 473/387–403; D21/717, 718

[56] References Cited

U.S. PATENT DOCUMENTS

| | | | |
|---|---|---|---|
| 1,479,689 | 1/1924 | Zeller | 473/397 |
| 1,545,959 | 7/1925 | Hugler . | |
| 1,952,113 | 3/1934 | Beckett . | |
| 2,127,282 | 8/1938 | Beckett . | |
| 2,450,206 | 9/1948 | Shouse . | |
| 2,948,536 | 8/1960 | Koener . | |
| 3,511,507 | 5/1970 | Gentiluomo | 473/135 |
| 3,966,213 | 6/1976 | Bradley | 473/136 |
| 5,297,797 | 3/1994 | Lamontagne | 473/133 |
| 5,356,148 | 10/1994 | Elder, Jr. . | |
| 5,569,101 | 10/1996 | O'Keeffe | 473/137 |
| 5,611,737 | 3/1997 | Rau et al. . | |

*Primary Examiner*—Steven Wong
*Attorney, Agent, or Firm*—Simon Groner

[57] ABSTRACT

An above-ground device that semi-automatically tees golf balls at practice areas such as driving ranges, without requiring the golfer to bend down and tee each golf ball by hand following each practice shot. The device comprises a U-shaped conduit which is embedded in the foam rubber backing of the playing surface mat typically found at a teeing area of a driving range in such a way that the openings in the conduit directly communicate with two holes drilled though the playing surface mat so as to create a continuous pathway between the two holes through the conduit. A semi-rigid rod is inserted into the conduit of such length that when one end is flush with the playing surface mat the other end protrudes above the playing surface mat approximately to the height of a standard golf tee. The ends of the rod are flared to substantially the shape of a standard golf tee.

20 Claims, 3 Drawing Sheets

SEMI-AUTOMATIC GOLF TEEING DEVICE

BACKGROUND OF THE INVENTION

1. Field of Invention

The present invention relates to an above-ground device that semi-automatically tees golf balls at practice areas such as driving ranges, without requiring the golfer to bend down and tee each golf ball by hand following each practice shot.

2. Description of the Prior Art

One of the most common activities that golfers engage in to hone their golfing skills is the practice of hitting golf balls at driving ranges. There, usually for a fee, a golfer is provided with a supply of golf balls (commonly referred to as "a bucket of balls") and a teeing area from where he or she can practice hitting golf balls. Before the golfer can hit a practice ball, he or she must first bend down to place a golf ball upon a tee. After the practice shot is taken, the golfer must repeat this procedure to prepare the next practice shot.

The repetitive bending by the golfer to set up a practice shot is disadvantageous both to the golfer and to the driving range operator. Bending down to set up the next shot interferes with the golfer's primary objective of practicing the hitting of golf balls. It drains the golfer's energy so that the golfer may not be strong enough to benefit from the entire practice session. Bending down also interrupts, or at least interferes with, the golfer's objective to perfect his or her golf swing. A golf swing is a complex process that depends upon the golfer's stance, grip of the golf club, the travel path of the golf club and various other factors. It would be ideal if a practicing golfer could alter one of the factors in his or her swing, evaluate the result, and with minimal delay and interruption, make another controlled change. Or, having found a swing that he or she likes, such a golfer would benefit if he or she could repeat that swing without undue delay or interruptions, until the golfer learns that swing. The process of bending down to set up the next shot interferes with the golfer's analysis and review of the last shot and the planning for the next shot. Also, the golfer's body position as he or she bends down, is so different from the golfer's swinging stance, that the golfer is not able to duplicate his or her last swing position in order to build upon the prior experience. The device of the present invention eliminates these disadvantages for the practicing golfer.

The operator of the driving range also benefits from the elimination of these disadvantages. The fee paid at a driving range is for a bucket of balls. It is not an hourly fee for the use of the driving range. Therefore, if the time in which the practicing golfer exhausts his supply of practice golf balls can be reduced, the driving range operator's income will increase, either through the sale of more buckets of balls or through the ability to accommodate a greater number of patrons. Obviously, the elimination of the necessity for the golfer to bend down to set up each shot will reduce the overall time required to hit a bucket of balls. Furthermore, when golfers improve their skills as a result of practicing at a driving range that has the device of the present invention, that driving range will gain increased income from repeat business and from new business as a result of endorsements from satisfied customers.

Numerous devices have been developed to enable the practicing golfer to set up a practice shot without bending down. Most are below-ground devices. One class of devices comprises a hopper containing a supply of golf balls from which the balls are removed one-at-a-time and each ball, in its turn, is placed upon a tee below ground. Then, the tee and the ball are raised above ground for the golfer's use. Once the golfer hits the ball, the mechanical cycle is repeated as the tee, without the ball descends below ground to receive the next golf ball from the hopper. Examples of these devices are U.S. Pat. No. 1,545,959, issued to D. Huyler on Jul. 14, 1925, U.S. Pat. No. 2,948,536, issued to R. F. Koener on Aug. 9, 1960 and U.S. Pat. No. 5,611,737, issued to Timothy P. Rau and Galen F. Byler on Mar. 18, 1997. Another class of devices comprises of a pair of tees connected to the opposite ends of an arm that pivots at its center. Through mechanical linkages located below ground, this arrangement permits the tees to have an alternating up-and-down movement. Thus, a ball is placed over the hole of a first tee that is at ground level. Downward pressure on the second tee that is above ground lowers the second tee to ground level and raises the first tee. The rising tee lifts the golf ball above it and presents it to the golfer for hitting. After the golfer hits the ball, the mechanical cycle is repeated by placing the next ball over the hole of the second tee that is at ground level and depressing the first tee down to ground level thereby raising the second tee. An example of this device is U.S. Pat. No. 5,569,101, issued to John J. O'Keefe on Oct. 29, 1996.

These below-ground devices all suffer from the same disadvantages that have prevented their commercial acceptance. They are expensive to manufacture, and because they must be installed below ground, they are expensive to install. Their installation also disrupts the operation of the driving range. Once installed, these devices require continuing maintenance, ranging from periodic lubrication to replacement of parts worn or damaged by dirt, moisture and repeated use.

SUMMARY OF THE INVENTION

The present invention relates to an above-ground device that semiautomatically tees golf balls at practice teeing areas, such as driving ranges, without requiring the golfer to bend down to tee each golf ball by hand. The device is entirely contained in the playing surface mat which lies directly upon the ground of the driving range. As such, the device of this invention can be easily and inexpensively incorporated into newly manufactured playing mats, or it can be retrofitted into existing playing mats.

A U-shaped conduit is embedded within the thickness of the foam rubber backing of a playing surface mat with each end of the conduit flush with the top surface of the foam rubber backing and aligned with two apertures in the playing surface mat such that the two apertures are connected to each other by the conduit. Into the conduit is inserted a semi-rigid tube or rod of such diameter and with such stiffness properties that it sidably moves with ease within the conduit upon the application of force to either of its ends, and yet it maintains its position within the conduit when the force is removed. The ends of the semi-rigid tube or rod are flared to approximately the same shape as the tops of ordinary golf tees. The length of the semi-rigid tube or rod is such that when one end is flush with the top of the playing surface mat the other end protrudes above the playing surface mat to the height of a standard golf tee inserted in the ground.

Accordingly, it is the principal object of this invention to provide an aboveground device that enables the practicing golfer to set up practice shots without bending down.

It is another object of the invention to provide a device without mechanical linkages which is inexpensive to manufacture, install and maintain.

These and other objects of the present invention will become readily apparent upon further review of the following specification and drawings.

DESCRIPTION OF THE PREFERRED EMBODIMENT

Figure 1:
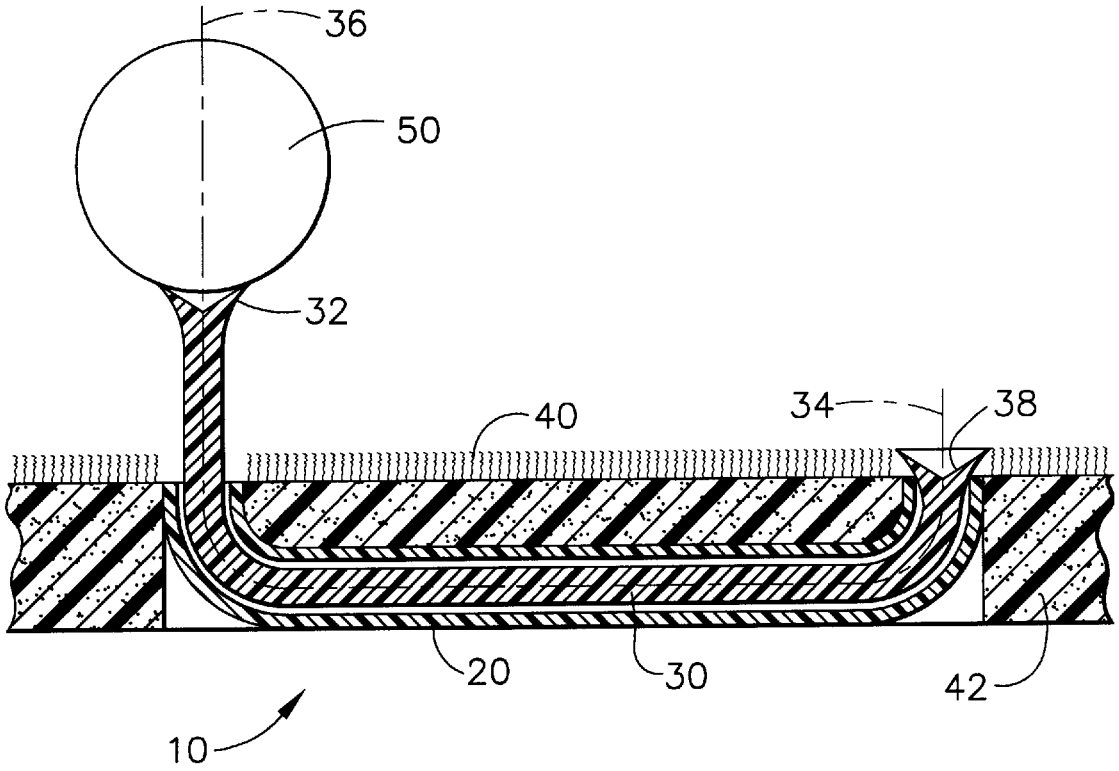
FIG. 1 is a sectional view of the device of the of the present invention.

FIG. 1 shows the device of this invention 10 embedded within the thickness of a playing surface mat. As further shown in FIG. 1, the playing surface mat upon which golfers at driving ranges practice their swings is comprised of a simulated grass surface 40 that is adhered to a foam rubber backing 42. Typically, the playing surface mat is laid directly upon the floor of the driving range, which is usually concrete, with the foam backing 40 in direct contact with the floor. The current practice is to drill holes through the playing surface mat to enable a standard tee to be inserted into the playing surface mat. The device of this invention is installed into the playing surface mat in the manner described directly below.

Conduit 20 is a rigid U-shaped tube with two vertical runs of equal height connected to the opposite ends of a horizontal run. The height of the vertical runs of the conduit 20 is such that the distance between the top of the vertical run to the bottom of the horizontal run is equal to the thickness of the foam rubber backing 42. Conduit 20 may be made of any rigid material, both rust-free metallic and non-metallic. Thus, for example, conduit 20 may be made of aluminum, stainless steel, copper, polyvinylchloride, polypropylene, polyethylene, rubber, and the like.

Two equal sized holes are drilled through the playing surface mat. The diameter of each hole is equal to the outside diameter of the conduit 20. In the preferred embodiment the outside diameter of conduit 20 is in the range of ¾ to 1 inch. The distance between the vertical center lines 34 and 36 of the conduit 20 is equal to the distance between the centers of the two holes in the playing surface mat. In the preferred embodiment the distance between the vertical centerlines 34 and 36 of conduit 20 is in the range of 4 to 8 inches.

Conduit 20 is inserted into the foam rubber backing 42 in such a manner that the bottom of the horizontal run of the conduit 20 is flush with the bottom of the foam rubber backing 42 and the tops of the vertical runs of the conduit 20 are flush with the top of the foam rubber backing 42 and is aligned so that the two holes drilled through the playing surface directly communicate with apertures of the vertical runs of the conduit 20 so as to create a continuous pathway between the two holes in the playing surface mat by means of the conduit 20. Those skilled in the art will recognize that conduit 20 is secured in its position by means of the vertical runs of the conduit 20 extending into the two holes in the foam rubber backing 42.

A semi-rigid rod 30 is inserted into conduit 20. The diameter of the rod 30 is slightly less than the inside diameter of the conduit 20, so as to enable the rod 30 to be slidably movable within conduit 20. Two concave pedestals 32 and 38 are formed at each end of the rod 30. The shape and size of each pedestal 32 and 38 is such that it can support a golf ball in a manner similar to that of a standard golf tee. The length of the rod 30 is greater than the linear length of the conduit 20 by the desired height that rod 30 is to extend above the simulated grass surface 40. In the preferred embodiment the desired height of the rod 30 above the simulated grass surface 40 is approximately equal to the height of a standard golf tee. Those skilled in the art will understand that the references to the shape and height of a "standard golf tee" are references to a device that is inserted into the ground to position a golf ball above grass surface and comprises a rod approximately 3/16 inches in diameter and approximately 2 inches high, with a tapered point at one end and a flared concave cup at the opposite end. The stiffness properties of the rod 30 must be such that the extended section of the rod 30 above the playing surface remains vertical and sufficiently stable to support a golf ball placed upon the concave pedestal 32 or 38, and such that the rod 30 slidably moves within conduit 20 when force is applied to either end of rod 30 and such that rod 30 maintains its position within conduit 20 when the force is removed from the end of the rod 30.

Figure 2:
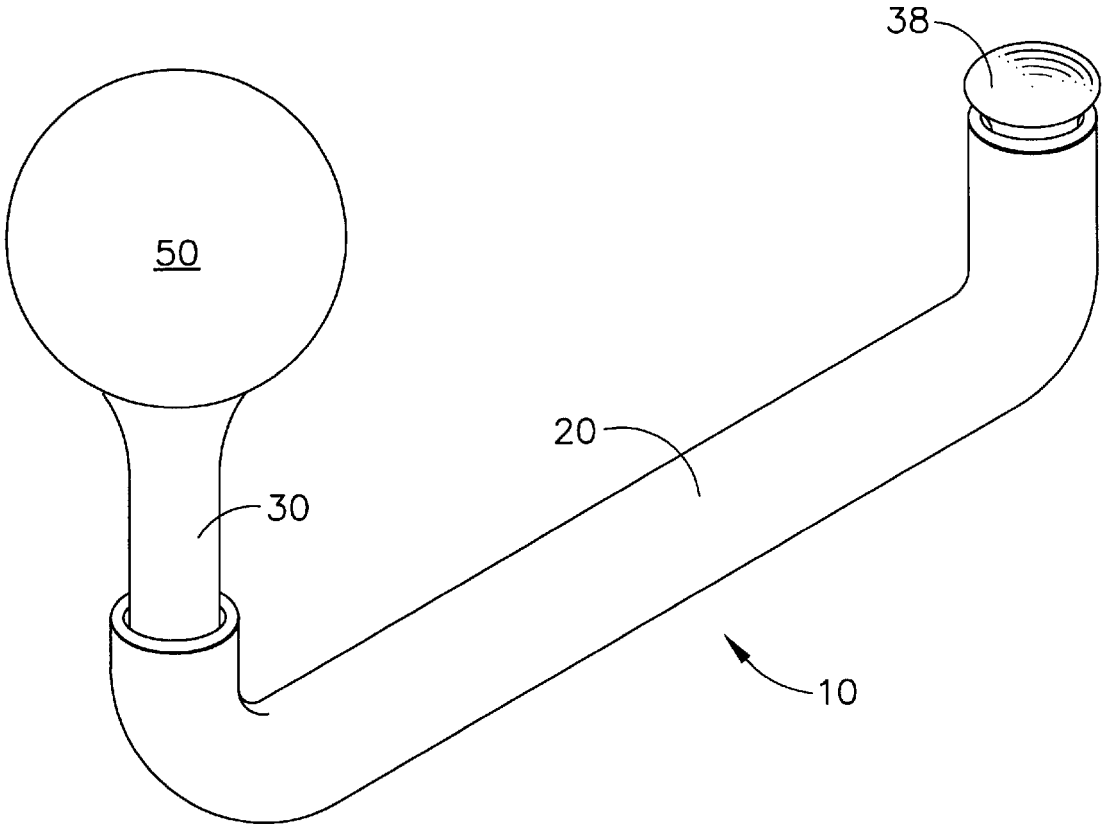
FIG. 2 is a perspective view of the device of the present invention as shown in FIG. 1, with the right tee in its lowered position while the left tee is in the raised position with a golf ball upon it.
Figure 3:
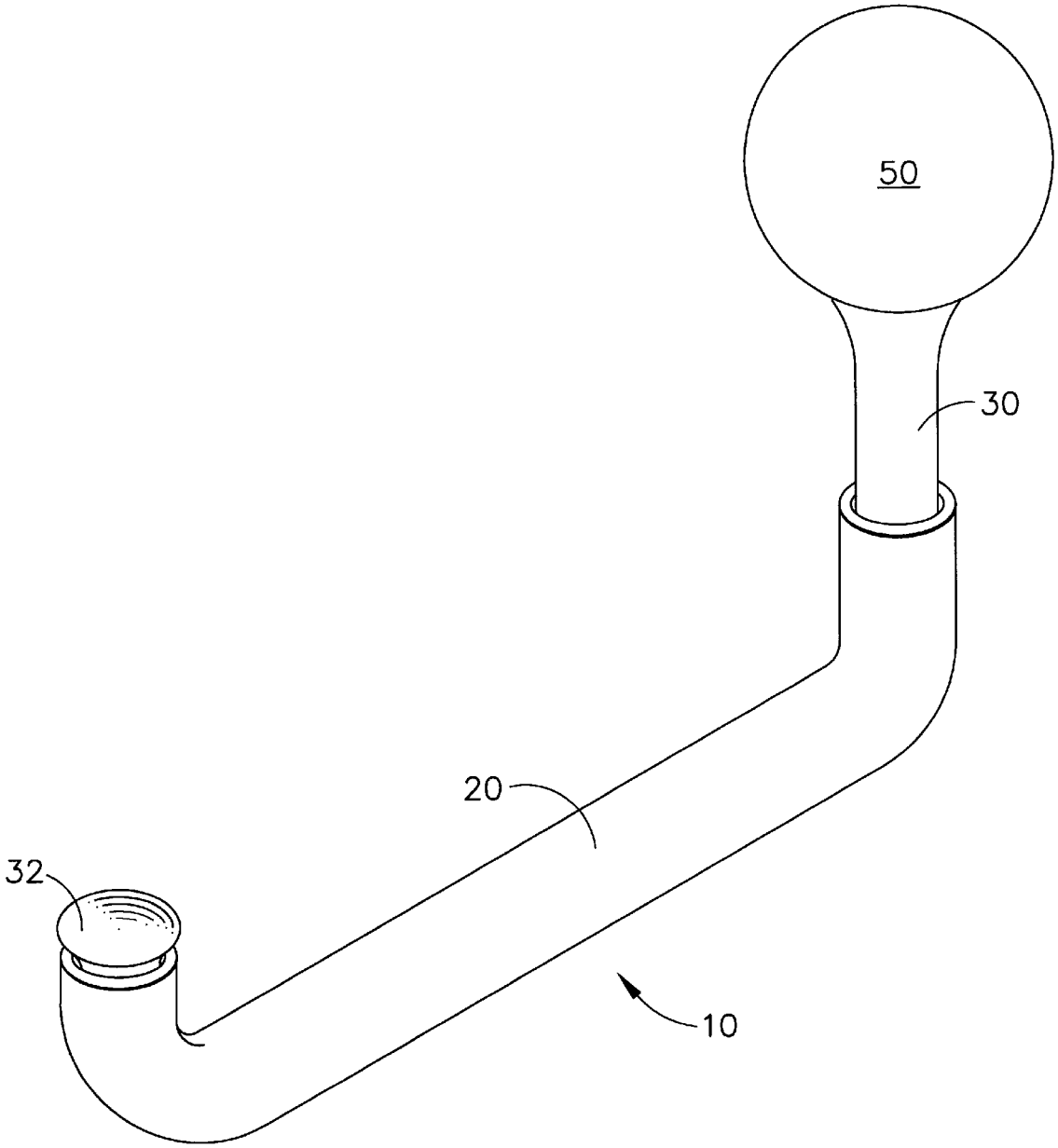
FIG. 3 is a perspective view of the device of the present invention as shown in FIG. 1, with the left tee in its lowered position while the right tee is in the raised position with a golf ball upon it.

In operation a practicing golfer places a supply of golf balls upon the simulated grass surface 40. The golfer uses his or her golf club to depress the left concave pedestal 32 to a position that is flush with or slightly below the simulated grass surface 40, as best shown in FIG. 3. Using his or her golf club the golfer positions one of the golf balls 50 upon the depressed left concave pedestal 32. The golfer now raises the golf ball 50 upon the left concave pedestal 32 by pushing down with his or her golf club on the right concave pedestal 38 until the golf ball 50 is raised to the desired level, at which point the golfer removes his or her golf club from the right concave pedestal 38, as shown in FIG. 2. With the golf ball at the desired height over the simulated grass surface 40, the golfer takes his or her practice shot. The gofer now repeats the foregoing procedure by depressing the right concave pedestal 38 and positioning the golf ball 50 on the right concave pedestal 38, as shown in FIG. 3.

It is to be understood that the present invention is not limited to the embodiments described above, but encompasses any and all embodiments within the scope of the following claims.

I claim:

1. A semi-automatic device for teeing golf balls comprising:

a playing surface mat comprising a simulated grass surface adhered to a foam rubber backing having two equal sized holes penetrating through said grass surface and foam rubber backing;

a rigid U-shaped conduit having an outside diameter approximately equal to the diameter of the said holes comprising two vertical runs of equal height and a horizontal run, with one vertical run connected to each end of the horizontal run and with the distance between the vertical centerlines of said conduit being equal to the distance between the centers of the two holes in the playing surface mat, the height of each vertical run being such that the distance between the top of the vertical run and the bottom of the horizontal run is equal to the thickness of the foam rubber backing, said conduit being embedded in said foam rubber backing such that the tops of the vertical runs of the conduit are substantially flush with the top of the foam rubber backing and the bottom of the horizontal run of the conduit is flush with the bottom of the foam rubber backing, and such that the vertical runs directly communicate with the two holes in the playing surface mat so as to create a continuous pathway between the two holes by means of said conduit;

a semi-rigid rod positioned within said conduit having a diameter that is slightly less than the inside diameter of the conduit and having a length that exceeds the linear length of the conduit by the desired height that the rod is to extend above the playing surface mat and having such stiffness properties that the rod sidably moves within said conduit when force is applied to either end of the rod and the rod maintains its position within the conduit when force is removed from either end of the rod, and such that the extended section of the rod above the playing surface remains vertical and sufficiently stable to support a golf ball upon its extended end; and two concave pedestals formed at each end of the rod.

2. The device according to claim 1 wherein the conduit is made of a non-rusting metal.

3. The device according to claim 2 wherein the non-rusting metal is aluminum.

4. The device according to claim 2 wherein the non-rusting metal is stainless steel.

5. The device according to claim 2 wherein the non-rusting metal is copper.

6. The device according to claim 1 wherein the conduit is made of a polymeric material.

7. The device according to claim 6 wherein the polymeric material is polyvinyl chloride.

8. The device according to claim 6 wherein the polymeric material is polypropylene.

9. The device according to claim 6 wherein the polymeric material is polyethylene.

10. The device according to claim 1 wherein the rod is made of rubber.

11. The device according to claim 1 wherein the rod is made of a polymeric material.

12. The device according to claim 11 wherein the polymeric material is polypropylene.

13. The device according to claim 11 wherein the polymeric material is polyethylene.

14. The device according to claim 11 wherein the polymeric material is nylon.

15. The device according to claim 1 wherein the distance between the vertical centerlines of said conduit is in the range of 4 to 8 inches.

16. The device according to claim 1 wherein the outside diameter of the conduit is in the range of ¾ to 1 inch.

17. The device according to claim 1 wherein the diameter of said semi-rigid rod is in the range of ½ to ¾ inch.

18. The device according to claim 1 wherein the height above the playing surface mat that said rod extends is approximately the height of a standard golf tee.

19. The device according to claim 1 wherein the shape of each said concave pedestal is substantially that of the top of a standard golf tee.

20. A semi-automatic device for teeing golf balls comprising:

a playing surface mat comprising a simulated grass surface adhered to a foam rubber backing having two holes of approximately ¾ inch diameter penetrating through said simulated grass surface and foam rubber backing, with the distance between the centers of the holes being 6 inches;

a rigid U-shaped conduit having an outside diameter of ¾ inch and an inside diameter of ⅝ inch comprising two vertical runs of equal height and a horizontal run with one vertical run connected to each end of the horizontal run and with the distance between the vertical centerlines of said conduit being equal to the distance between the centers of the two holes in the playing surface mat, the height of each vertical run being such that the distance between the top of the vertical run and the bottom of the horizontal run is equal to the thickness of the foam rubber backing, said conduit being embedded in said foam rubber backing such that the tops of the vertical runs of the conduit are substantially flush with the top of the foam rubber backing and the bottom of the horizontal run of the conduit is flush with the bottom of the foam rubber backing, and such that the vertical runs directly communicate with the two holes in the playing surface mat so as to create a continuous pathway between the two holes by means of said conduit;

a semi-rigid rod positioned within said conduit having an outside diameter of ½ inch and having a length that exceeds the linear length of the conduit by approximately the height of a standard golf tee, having such stiffness properties that the rod slidably moves within said conduit when force is applied to either end of the rod and the rod maintains its position within the conduit when force is removed from either end of the rod, and such that the extended section of the rod above the playing surface remains vertical and sufficiently stable to support a golf ball upon its extended end; and two concave pedestals formed at each end of the rod, each having substantially the shape of the top of a standard golf tee.

* * * * *